United States Patent [19]

Schmolke

[11] Patent Number: 4,983,808

[45] Date of Patent: Jan. 8, 1991

[54] METHOD OF PRODUCING OPENING ROLLER RINGS

[75] Inventor: Karl-Heinz Schmolke, Neuweiler, Fed. Rep. of Germany

[73] Assignee: Hollingsworth GmbH, Neubulach, Fed. Rep. of Germany

[21] Appl. No.: 374,328

[22] Filed: Jun. 30, 1989

[30] Foreign Application Priority Data

Jul. 28, 1988 [DE] Fed. Rep. of Germany ..... 3825739

[51] Int. Cl.[5] ..... B23K 26/00

[52] U.S. Cl. ..... 219/121.64; 219/121.72

[58] Field of Search ..... 219/121.63, 121.64, 219/121.13, 121.14, 121.67, 121.72

[56] References Cited

U.S. PATENT DOCUMENTS 4,873,416 10/1989 Boder ..... 219/121.14

FOREIGN PATENT DOCUMENTS 2002639 8/1970 Fed. Rep. of Germany .
497561 11/1970 Switzerland .
854090 11/1960 United Kingdom .
2022640 12/1979 United Kingdom .
2022640 12/1979 United Kingdom .

*Primary Examiner*—C. L. Albritton
*Attorney, Agent, or Firm*—Townsend and Townsend

[57] ABSTRACT

A method producing opening roller rings for open-end spinning machines whereby a saw-tooth wire provided with a foot, is helically wound on a core and welded together to form a tube; the core is forced out of the tube and is subsequently cut to form opening roller rings.

8 Claims, 4 Drawing Sheets

METHOD OF PRODUCING OPENING ROLLER RINGS

DESCRIPTION

Figure 1:
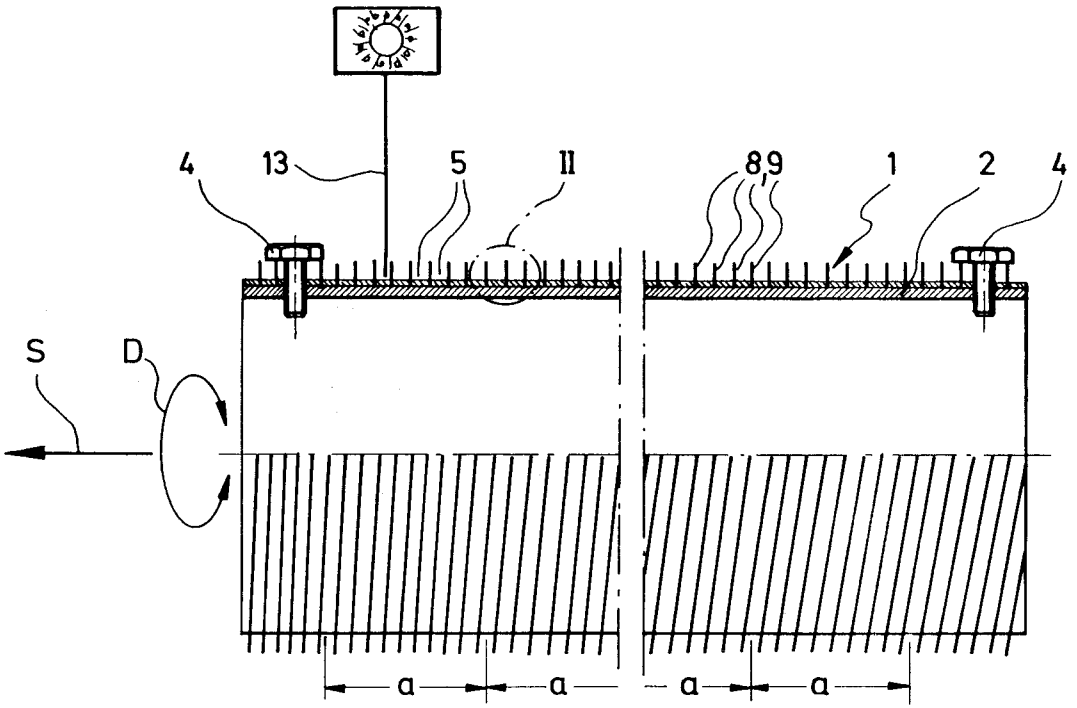

The present invention refers to a method of producing opening roller rings, in particular for open-end spinning machines, including the step of helically winding a saw-tooth wire provided with a foot onto the ring along the length of said ring, the foot portions of neighbouring saw-tooth wire windings contacting each other. The present invention additionally refers to a saw-tooth wire for carrying out said method.

Normally, opening roller rings are produced by winding a saw-tooth wire onto a tubular member having already the length of the finished opening roller ring, the starting end and the tail end of the saw-tooth wire being secured to said tubular member. This manufacturing method is unsatisfactory with regard to the demanded accuracy of circular movement of opening roller rings. Hence, opening roller rings plus their saw-tooth clothing are frequently cut from solid material so as to be able to achieve the demanded accuracy of circular movement, such cutting being complicated and expensive.

German patent application No. 38 05 281, which has not yet been published, describes a method of producing opening roller rings in the case of which a saw-tooth wire is wound onto a tube which is several times as long as a ring. At distances corresponding approximately to the future ring length, the teeth of the saw-tooth wire windings are removed down to the foot of the saw-tooth wire so that circumferentially extending grooves are formed. In these grooves the saw-tooth windings are welded to the tube by means of a laser or electron beam, whereupon the tube is divided into the individual opening roller rings approximately at the centre of the circumferentially extending grooves. On the basis of this method, it is made possible that the saw-tooth wire windings rest uniformly on the tubular member throughout the entire length of the ring, i.e. that no irregularities will occur at the starting end and at the tail end of the saw-tooth wire windings. It follows that the demanded accuracy of circular movement can be achieved on the basis of this method. For reasons of stability, it is, however, necessary that the saw-tooth wire windings remain on the tube so that the wall thickness of the opening roller rings cannot be reduced below a specific minimum thickness.

The present invention is based on the task of providing a method of producing opening roller rings of the type mentioned at the beginning, which permits high accuracy of the opening roller rings in combination with a small wall thickness.

In accordance with the present invention, this task is solved by the features that the saw-tooth wire is wound onto a core which is several times as long as a ring, that the foot portions of neighbouring saw-tooth wire windings are interconnected so as to form a tube, and that the interconnected saw-tooth wire windings are removed from the core whereupon the tube is divided into the individual opening roller rings.

It is thus possible to produce in a surprisingly simple manner an opening roller ring having a small wall thickness on the one hand and a high accuracy of circular movement on the other. It is true that EP-A-142 073 discloses a method of producing a needle carrier in the case of which the basic body provided with the needles is formed by a helically wound carrier band provided with openings, the windings of said carrier band being joined by means of an adhesive. This known method, however, differs from the method according to the present invention not only in so far as it refers to a needle carrier but, quite essentially, also in so far as only a basic body is wound in the case of said known method. This means that, caused by the starting end and the tail end of the carrier band, the same problems with regard to a circular movement which arose in the case of the manufacturing method of the type mentioned at the beginning will arise in the case of this method as well.

In accordance with a preferred embodiment of the present invention, the teeth in a respective circumferentially extending groove, which extends approximately down to the foot of the saw-tooth wire, are removed at distances corresponding approximately to the length of the ring and, subsequently, the tube is separated approximately at the centre of the circumferentially extending grooves so as to form the individual opening roller rings. This has the effect that the two sides of the opening roller rings will be toothfree so that the flanged disks, which are frequently used for supporting the opening roller rings, can be attached to these sides without any difficulties.

In accordance with one variant of the method, the end faces of the opening roller rings can be bevelled towards the upper side thereof also after separating the tube into the individual opening roller rings. In many cases, the bevel thus produced can already suffice to prevent any influence of the teeth, which are located on the end faces, on the flanged disks provided for the purpose of support.

A preferred possibility of interconnecting the individual foot portions of neighbouring saw-tooth wire windings is the possibility of welding said foot portions together. An integral tube is thus obtained, said tube being subsequently separated into the individual opening roller rings.

In accordance with a particularly preferred embodiment, the foot portions are welded together by means of an electron or laser beam which is continuously guided along the saw-tooth wire windings. The electron beam or laser beam welding process permits welding also in extremely limited spaces so that also saw-tooth wires having a small foot can be interconnected in an adequate manner. Moreover, the welding depth of the weld can be adjusted quite precisely so that the saw-tooth wires can easily be prevented from being welded to the core.

When the electron or laser beam is caused to extend at an oblique angle relative to the core axis during the welding process of the saw-tooth wire windings, it will be possible to use known saw-tooth wires with foot linking and foot interlocking, respectively, in the case of which the areas of contact between neighbouring feet are positioned below the saw teeth. This area of contact can be reached by an oblique electron or laser beam.

Neighbouring saw-tooth wire windings can be welded together in a particularly simple manner, when the core having provided the windings thereon is rotatingly moved past a welding beam, which is directed onto the respective foot portion, at a feed rate corresponding to the pitch of the saw-tooth wire windings. This method is carried out in correspondence with the cutting of a thread by means of a lathe, the shaft to be provided with a thread being in this case moved past the cutting steel at a specific feed rate.

A particularly simple separation of the tube into the individual opening roller rings can be achieved, when the tube is separated by means of an electron beam or a laser beam. Smooth end faces are thus obtained, which no longer show where a winding of the saw-tooth wire begins.

The method can be carried out in a particularly preferred manner by using a saw-tooth wire whose foot has on one side thereof a projection extending along the entire length of the wire and on the other side thereof a complementary recess so that, when the wire is wound onto the core, the projections and the recesses of neighbouring saw-tooth wire windings will come into engagement with one another, the recess and the projection having a depth which exceeds the width of the teeth of the saw-tooth wire. It is thus achieved that the projection of a saw-tooth wire winding can penetrate into the foot of the neighbouring saw-tooth wire up to a point adjacent the teeth so that, when the windings are welded together, parts of the neighbouring foot portions are placed one on top of the other, the welding beam penetrating through these superposed parts. This has the effect that a particularly firm connection between the individual wire windings is achieved. It is true that profiled saw-tooth wires are already known whose feet have lateral projections and recesses, so-called wires with foot linking or foot interlocking, the projections and recesses having in this case approximately a depth which corresponds to the tooth width, but the linking in the case of these saw-tooth wires only serves the purpose of maintaining the windings in an interlocked condition even if tearing of an individual winding occurs due to the fact that the cylinder of a carding machine, which has wound thereon the saw-tooth wires, is subjected to extraordinary stress. Even in the case of such tearing, the windings will remain in an interlocked condition due to the linking so that the whole saw-tooth cover is prevented from coming off, and this avoids any damage which might be caused to the working members of the carding machine which are arranged around the cylinder.

In accordance with a preferred embodiment, the foot of the saw-tooth wire has one one side thereof a projection, which is provided with a V-shaped cross-section and the upper and the lower side of which converge towards the side, a complementary V-shaped recess being provided at the opposite side of said foot. This provides the advantage that positive fixing in the vertical direction, i.e. radially to the core, is already effected when the saw-tooth wire windings are wound onto the core and that, during the welding process, two boundary surfaces between the two neighbouring saw-tooth wire windings are exposed to the welding beam in the case of each winding.

In accordance with a preferred embodiment, the depth of the recess in the foot of a saw-tooth wire corresponds approximately to the width of the saw-tooth wire leaving out of account the projection. This means that, when seen in the axial direction of the opening ring, the projection of a saw-tooth wire will penetrate virtually completely into the foot portion of the neighbouring saw-tooth wire winding. A large overlapping area of neighbouring saw-tooth wire windings is thus achieved.

It turned out to be advantageous when the upper side and the lower side of the projection enclose an angle of approx. 60°.

A further saw-tooth wire which is adapted to be used for carrying out the method in a preferred manner includes a foot having an essentially L-shaped configuration and extending along the whole length of the wire, the upper side as well as the lower side of said foot being provided with a stepped structural design transversely to the longitudinal direction of the saw-tooth wire so that, in the wound-on condition of the saw-tooth wire, the respective upper side of one step of a saw-tooth wire winding contacts the lower side of a step which belongs to a neighbouring saw-tooth wire winding and which is arranged on top of said first-mentioned step. In accordance with a particularly preferred embodiment, the foot is provided with at least two steps so that two respective upper and lower sides contact each other between neighbouring saw-tooth wire windings. This has the effect that a particularly good fixation of neighbouring saw-tooth wire windings is achieved, and, moreover, it is possible to weld several boundary surfaces together by using an oblique laser or electron beam.

When the depth of a step corresponds to approximately half the width of the foot at this location of the foot, it will be possible to achieve—in particular when the height of a step corresponds to approximately half the thickness of the foot at this location of the foot—that the foot of the saw-tooth wire has essentially the same thickness of material at all points thereof, and this provides the advantage that the saw-tooth wire can be produced in a particularly simple manner without any distortions, and this will, in turn, have a positive influence on the quality of the opening roller rings produced by means of this saw-tooth wire.

The welding of the individual saw-tooth wire windings can be simplified in an advantageous manner when the sum of the depths of the steps is chosen such that it corresponds to approximately half the overall width of the foot, since it will then be possible to conduct the laser or electron beam precisely radially to the core axis between the windings because it will there always impinge on boundary surfaces.

Figure 2:
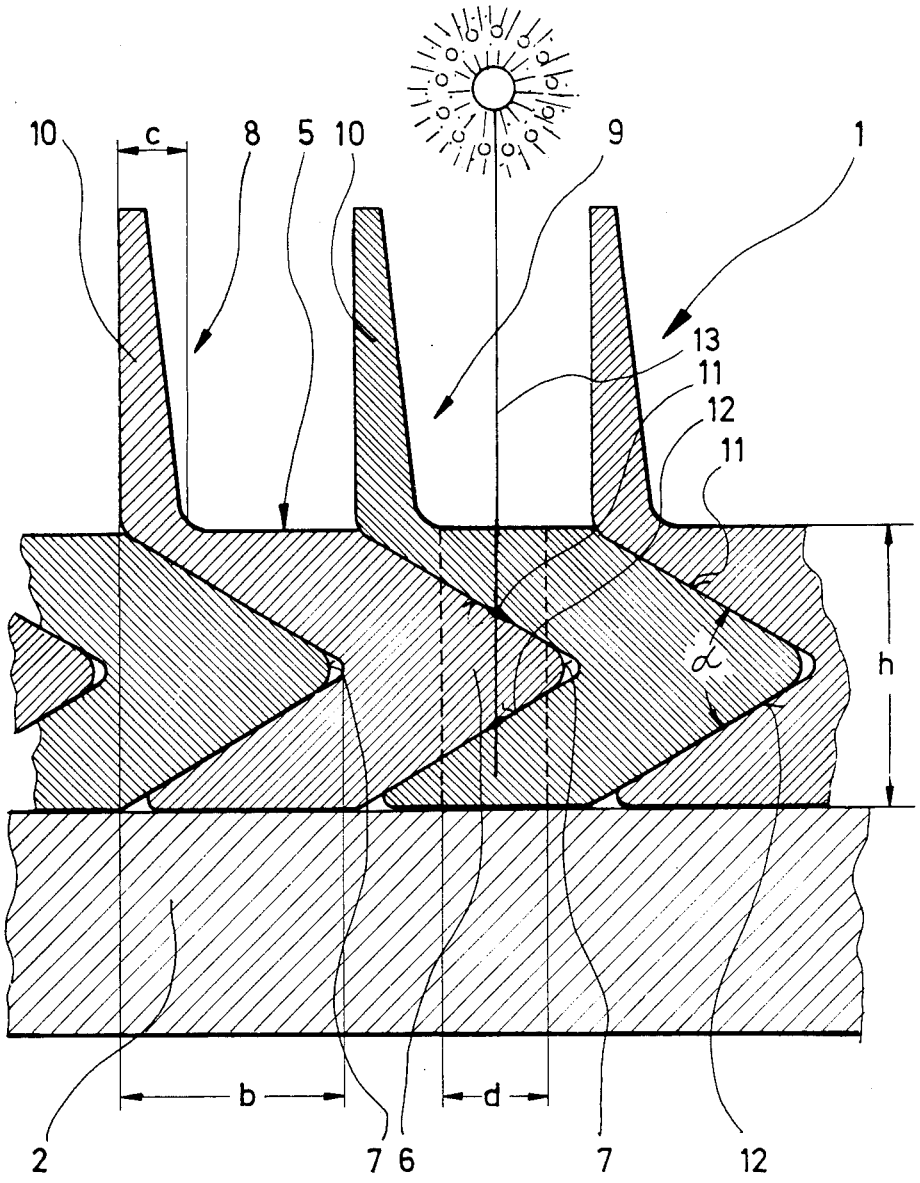
Figure 3:
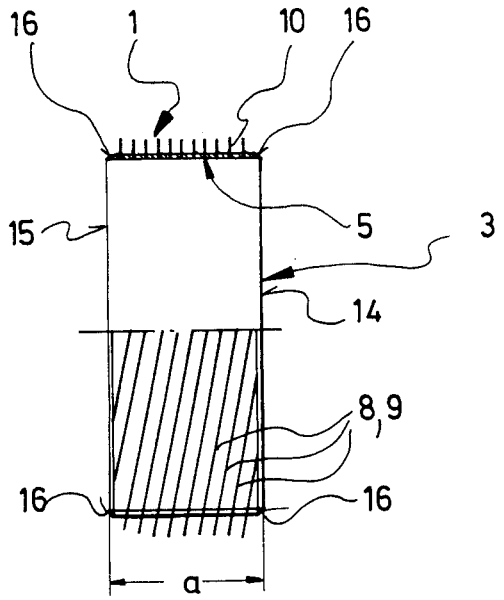
Figure 4:
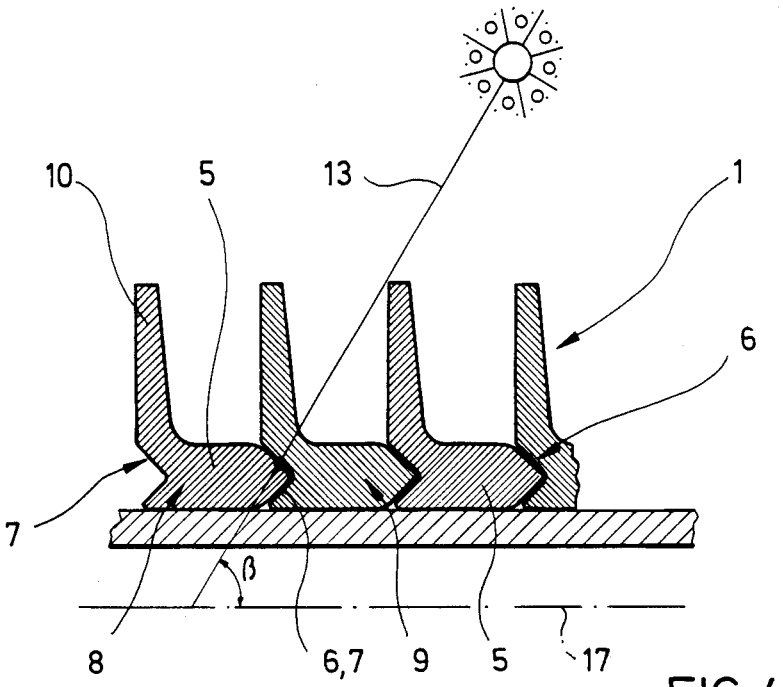
Figure 5:
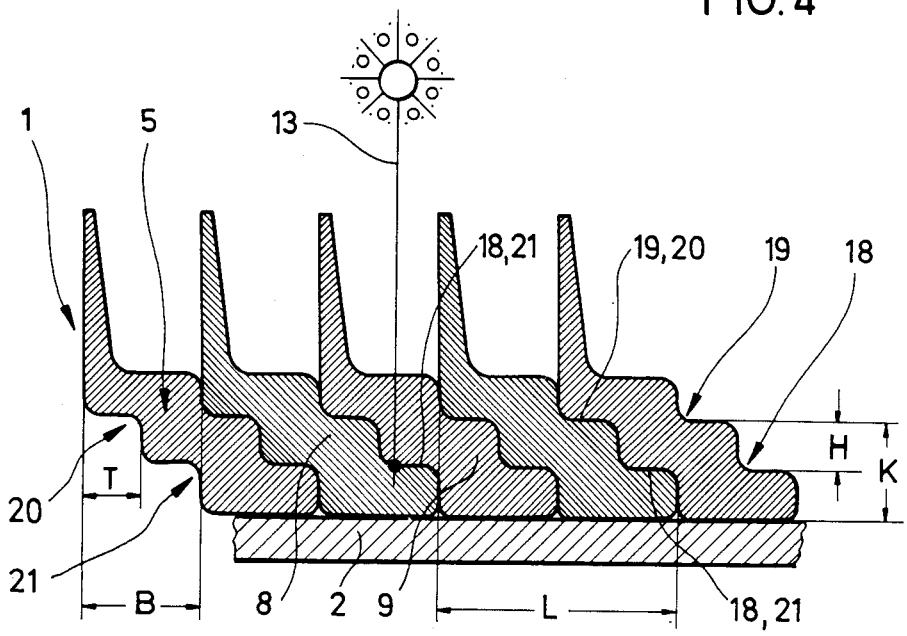

In the following one embodiment of the invention will be described in detail on the basis of a drawing in which:

FIG. 1 shows a core having wound thereon a saw-tooth wire for producing opening roller rings, FIG. 2 shows strongly enlarged view of a detail II of FIG. 1 in a sectional drawing, FIG. 3 shows a finished, partially cut opening roller ring, FIG. 4 shows in a view which is similar to that of FIG. 2 another saw-tooth wire which is just being welded by means of an oblique laser beam, and FIG. 5 shows in a view which is similar to that of FIG. 4 a further variant having a saw-tooth wire with a stepped foot portion.

FIG. 1 shows a core 2 which has wound thereon a saw-tooth wire 1 and the length of which is several times as long as the length a of an individual opening roller ring 3. The starting end and the tail end of the saw-tooth wire 1 are secured on the core by means of screws 4.

As can more easily be seen from FIG. 2, the saw-tooth wire 1 is a type of saw-tooth wire including a lateral foot 5. The foot 5 has a projection 6 on one side thereof and a recess 7 on the other side thereof, the projection 6 of one winding 8 engaging the recess 7 of a neighbouring winding 9. The depth b of a recess 7 is several times as large as the width c of a tooth 10 of the saw-tooth wire in the case of the embodiment shown in this figure. The depth b of the recess 7 corresponds to almost the whole width of the foot, when the depth of the projection 6 is left out of account.

FIG. 2 shows clearly that the projection 6 and the recess 7 have a V-shaped cross-section, the upper side 11 and the lower side 12 of the projection 6 converging towards the side. In the case of the embodiment described in the present connection, the angle $\alpha$ enclosed by the upper side 11 and the lower side 12 is 60°.

In view of these geometrical circumstances, a toothfree overlapping zone d is achieved between the foot portions 5 of neighbouring windings 8 and 10, said overlapping zone d amounting to approximately half the footh width.

In the following, the method of producing an opening roller ring 3 will be explained in detail, the above-described saw-tooth wire being used for said method.

First of all, a tubular core 2 has wound thereon the saw-tooth wire 1, the projections 6 of the windings 8 engaging the recesses 7 of the respective neighbouring windings 9. The starting end and the tail end of the saw-tooth wire 1 wound thus onto the core 2 are secured by means of screws 4. The individual windings 8 and 9 of the saw-tooth wire 1 are then welded together by means of a laser or electron beam 13. In said welding process, the welding beam 13 stationarily aims at the foot portion 5 between two neighbouring windings 8 and 9 of the saw-tooth wire 1, whereas the core 2 is rotated about its axis in the direction of the arrow D and is moved in the direction of the arrow S in accordance with the pitch of the windings 8 and 9 of the saw-tooth wire 1. This has the effect that the core rotatively moves past the welding beam 13 in a continuous mode, said welding beam aiming always at the foot portion 5 between two windings 8 and 9 during these movements. The welding depth of the welding beam 13 is adjusted such that it amounts to approximately 90% of the height h of the foot 5 of the saw-tooth wire 1.

This has the effect that the feet of neighbouring windings 8 and 9 are welded together in the area of the overlapping zone d at two boundary surfaces, viz. at the respective upper side 11 and lower side 12 of a projection 6, without any connection of the foot 5 and the core 2 being established.

As soon as the windings 8 and 9 of the saw-tooth wire 1 are completely welded together, the screws 4 are loosened, whereupon the welded saw-tooth wire 1 is pressed off the core 2 by means of a press. In accordance with the length a of the future opening roller ring, circumferentially extending grooves can now be ground into said saw-tooth wire in the manner described in German patent application No. P 38 05 281. However, in the case of the embodiment described in the present connection the opening roller rings 3 are separated from the wound saw-tooth wire, which now forms a core, without any previous grinding of circumferentially extending grooves. This separation, too, can be effected by means of a laser or electron beam.

Subsequently, the end faces 14 and 15 of the opening roller ring 3 are provided with a bevel. Depending on the kind of future use of such an opening roller ring, additional grinding of the inner side of the ring can afterwards be carried out.

As has been described in German patent application No. P 38 05 281, the method described in the present connection may additionally include an intermediate step in the course of which the saw-tooth wire 1 is plasma-coated after having been wound onto the core 2.

Although the method was described by making use of a saw-tooth wire with foot linking, it is just as well imaginable that the method can be carried out with a saw-tooth wire with foot interlocking. In any case, however, attention will have to be paid to the fact that, in the case of laterally arranged feet, the depth of the projections and of the recesses, respectively, should exceed the width of a tooth so as to obtain a toothfree overlapping zone which is advantageous for the purpose of laser welding.

FIG. 4 shows an additional embodiment of the present invention. Identical reference numerals will be used for identical and similar structural components. FIG. 4 shows the method which makes use of a saw-tooth wire 1 with foot linking according to DIN 64124 sheet 3. This saw-tooth wire differs from the saw-tooth wire used in the case of the above-described embodiment with regard to the fact that the depth of the recesses 7 and of the projections 6, respectively, is smaller than or identical to the tooth width c. The laser beam is adjusted such that it has an angle of incidence $\beta$ relative to the axis 17 of the tube 2 so that it impinges obliquely on the foot 5 of the saw-tooth wire, it being thus possible to produce also from this type of saw-tooth wires an opening roller ring by means of the method according to the present invention. The laser beam will thus also arrive at the area below the teeth, viz. the area where the projections 6 and the recesses 7 engage one another. As for the rest, the method corresponds to the embodiment described hereinbefore.

In FIG. 5 an additional embodiment is described, which, too, corresponds to the first described embodiment in principle, a saw-tooth wire 1 with foot interlocking being, however, used in said FIG. 5. The saw-tooth wire used in the present connection is a wire in the case of which the upper side as well as the lower side of the foot 5 is stepped. The upper side and the lower side of the foot 5 are each provided with two steps 18/19 and 20/21, respectively. The upper sides of the steps extend horizontally, whereas the portions connecting the individual steps extend perpendiculary or radially to the axis of the tube 2. The depth T of the individual steps 18 to 21 amounts to approximately half the width B of the foot 5 at this location. The overall width L of the foot 5 is four times as large as the depth T of one of the steps 18 to 21.

The height H of one step 18 to 21 is approximately half the thickness K of the foot 5 at this location. The overall height of a foot 5 is approximately equal to three times the height of one of the steps 18 to 21.

When the individual windings 8 and 9, respectively, are welded together, the laser beam 13 impinges on the boundary surface between the upper side of the step 18 and the lower side of the step 21. The two windings 8 and 9 are welded together at this location. In principle, it is, however, also possible to effect the welding between the upper side of the step 19 and the lower side of the step 21. When an obliqué laser beam is used, welding can also be effected at both boundary surfaces so that three saw-tooth wire windings would be connected by one weld.

The further sequence of method steps for producing the opening roller ring corresponds to that of the first embodiment described.

Finally, the measure of welding the saw-tooth wire windings together in a tubular configuration also provides the advantage that the inner wall of the opening roller ring can be subjected to additional high-precision-grinding so as to meet the highest requirements with regard to accuracy.

I claim:

1. A method for producing opening roller rings, in particular for open-end spinning machines, comprising the steps of helically winding a saw-tooth wire provided with a foot onto a core having an axis which is several times as long as the length of an opening roller ring, interconnecting the foot portions of neighbouring saw-tooth wire windings so as to form a tube, removing the tube formed of said interconnected saw-tooth wire windings from the core, and dividing the tube formed of said interconnected saw-tooth wire windings into individual opening roller rings.

2. A method according to claim 1 wherein the said teeth are in a respective circumferentially extending groove, said groove extending approximately down to the foot of said saw-tooth wire, said teeth removed at distances corresponding approximately to the length of the ring, so that, subsequently, the tube is separated approximately at the centre of the circumferentially extending grooves so as to form the individual opening roller rings.

3. A method according to claim 1 wherein the end faces of the opening roller rings are bevelled towards the upper side thereof after separating the tube into the individual opening roller rings.

4. A method according to claim 1 wherein said foot portions of said neighbouring saw-tooth wire windings are welded together.

5. A method according to claim 1 wherein said foot portions are welded together by means of an electron or laser beam which is continuously guided along the saw-tooth wire windings.

6. A method according to claim 5 wherein said electron or laser beam is caused to extend at an oblique angle to said core axis during the welding process of said saw-tooth wire windings.

7. A method according to claim 1 wherein said core having windings thereon is rotatingly moved past a welding beam, said welding beam directed onto said respective foot portions, at a feed rate corresponding to the pitch of the saw-tooth wire windings.

8. A method according to claim 1 wherein said tube is separated into the individual opening roller rings by means of an electron beam or a laser beam.

* * * * *